United States Patent [19]

Groth

[11] 4,394,791

[45] Jul. 26, 1983

[54] CLOSURE CLAMP FOR FOOD BAGS

[76] Inventor: Francis R. Groth, 12561 Glenfield, Detroit, Mich. 48213

[21] Appl. No.: 267,128

[22] Filed: May 26, 1981

[51] Int. Cl.[3] ..... B65D 77/10

[52] U.S. Cl. ..... 24/30.5 R; 24/252 R

[58] Field of Search ..... 24/30.5 R, 67.5, 137 R, 24/252 R, 252 A, 137 A; 229/62; 24/243 R, 248 R, 67.3, 331, 327

[56] References Cited

U.S. PATENT DOCUMENTS

| | | | |
|---|---|---|---|
| 1,181,756 | 5/1916 | Fonville | 24/67.5 |
| 1,531,680 | 3/1925 | Stenersen | 24/252 R X |
| 1,590,682 | 6/1926 | Hart | 24/30.5 R |
| 2,223,978 | 12/1940 | Dew | 129/16 |
| 2,593,201 | 4/1952 | Saunders | 24/137 A |
| 2,641,811 | 6/1953 | Morgan | 24/137 |
| 2,854,717 | 10/1958 | O'Farrell et al. | 24/30.5 |
| 3,131,449 | 5/1964 | Iida | 24/137 |
| 3,138,361 | 6/1964 | Meldrum | 248/95 |
| 3,191,365 | 6/1965 | Feeley | 229/62 X |
| 3,235,928 | 2/1966 | Clark | 24/137 R |
| 3,476,341 | 11/1969 | Patterson | 248/95 |
| 3,756,550 | 9/1973 | Kollitz | 248/206 A |
| 4,109,351 | 8/1978 | Coffey | 24/258 |

FOREIGN PATENT DOCUMENTS

| | | | |
|---|---|---|---|
| 571002 | 8/1945 | United Kingdom | 24/137 A |

*Primary Examiner*—Mickey Yu

*Attorney, Agent, or Firm*—Reising, Ethington, Barnard, Perry, Brooks & Milton

[57] ABSTRACT

A closure clamp is disclosed for use with food bags, such as potato chip bags. It comprises a pair of clamp members in hinged construction and a torsion spring for holding the members together and applying a clamping force. Each clamp member includes a jaw, a handle and a fulcrum member and the spring includes a torsion rod disposed between the fulcrum member and the free ends of the handles. The jaws are bar-like structures and are long enough to span a large part of the width of a food bag.

5 Claims, 4 Drawing Figures

CLOSURE CLAMP FOR FOOD BAGS

FIELD OF THE INVENTION

This invention relates to closure devices for food bags and the like; more particularly, it relates to a combined closure clamp and support device for closing the open end of a food bag such as a potato chip bag, and hanging it on a support hook.

BACKGROUND ART

Many different food products are currently sold in sealed bags to retain the freshness of the product until the bag is opened by the consumer. The bags are constructed of such material and sealed in such a manner that a bag is usually torn irregularly or otherwise mutilated at the end when it is opened. The commonly used bag material does not fold easily or hold a crease and the bag exhibits a slippery surface. As a result, the bag cannot be reclosed without the aid of a special closure device. In the prior art, certain bag closure devices have been proposed; however, such devices have been unsatisfactory either because of complexity, cost or ineffectiveness with the present day food bag.

A food bag closure device is shown in the O'Farrell et al U.S. Pat. No. 2,854,717. This device comprises a band of spring wire forming a flat loop having opposed elongated side sections which tend to close against each other. The top edges of the bag are folded over the side edges of the loop so that the spring loop tends to close the mouth of the bag. The Coffey U.S. Pat. No. 4,109,351 discloses a clamp for closing milk cartons. The device of this patent comprises a U-shaped member which slides over the flap of the milk carton and a member is provided for squeezing the sides of the U-shaped clamp together.

Clamping devices for supporting bags or other receptacles, such as litter bags, are known in the prior art. The Meldrum U.S. Pat. No. 3,138,361 and the Patterson U.S. Pat. No. 3,476,341 disclose devices which comprise a support plate having a spring loaded clamp member pivotally mounted on the plate for gripping the bag between the clamp member and the plate. Devices of similar structure for holding sheets of paper, such as a clipboard, are shown in the Kollitz U.S. Pat. Nos. 3,756,550, and the Fonville U.S. Pat. No. 1,181,756. The Dew U.S. Pat. 2,223,978 discloses a device for holding a stack of papers together for filing. It includes a pair of jaws each having a handle extending therefrom and spring means for biasing the jaws in the closed position.

The prior art also includes clothespin-type clamps such as those disclosed in the Morgan U.S. Pat. Nos. 2,641,811 and the Iida patent 3,131,449.

A general object of this invention is to provide an improved closure clamp and support device which overcomes the disadvantages of the prior art, such device being especially adapted for closing and hanging food bags.

SUMMARY OF THE INVENTION

According to this invention, a closure clamp is provided for food bags which closes the bag and may also serve as a hanger for supporting the bag from a hook. The closure clamp is easily applied to and removed from the bag and is of simple low cost construction. It comprises a pair of clamp members adapted for hinged connection and a spring for holding the members together and applying a clamping force. Each clamp member includes a jaw, a handle and a fulcrum means. The spring includes a torsion rod disposed between the fulcrum members and the free ends of the handles for holding the fulcrum means together and urging the jaws closed. The jaws are bar-like structures and are long enough to span a large part of the width of a food bag.

More particularly, the invention comprises a food bag clamp including a pair of clamp members, each of which includes a bar-like jaw and a handle extending transversely of the jaw with fulcrum means disposed on the handle. The jaws are of equal length and the handles are of equal length and the clamp members are disposed with the fulcrum means in pivotal engagement with the jaws and handles respectively opposite each other. The torsion spring has a torsion element disposed between the fulcrum means and the free ends of the handles and holds the fulcrum means together and urges the jaws closed. The torsion spring comprises a wire having an intermediate straight torsion bar section disposed between the fulcrum means and the free ends of the handles; the wire has first and second straight side sections extending, respectively, along the first and second handles toward the jaws and the wire terminates in first and second end sections extending, respectively, across the handles adjacent the jaws to urge the jaws closed. The fulcrum means on one of the handles comprises a post extending transversely thereof toward the other of the handles and the fulcrum means on the other of the handles comprises a socket for receiving the end of the post in pivotal connection. Preferably, the fulcrum means on each of said handles comprises a post and a socket disposed in lateral alignment with each other with the post on one handle being received in pivotal engagement by the socket on the other handle. Preferably, each clamp member is a unitary body of plastic and each clamp member is identical in construction to the other clamp member. A gripping member on each of said jaws is provided by a tube of pliable material with the tubes disposed opposite each other for gripping engagement with a food bag therebetween when the jaws are closed.

A more complete understanding of this invention may be obtained from the description that follows taken with the accompanying drawing.

BEST MODE FOR CARRYING OUT THE INVENTION

Figure 1:
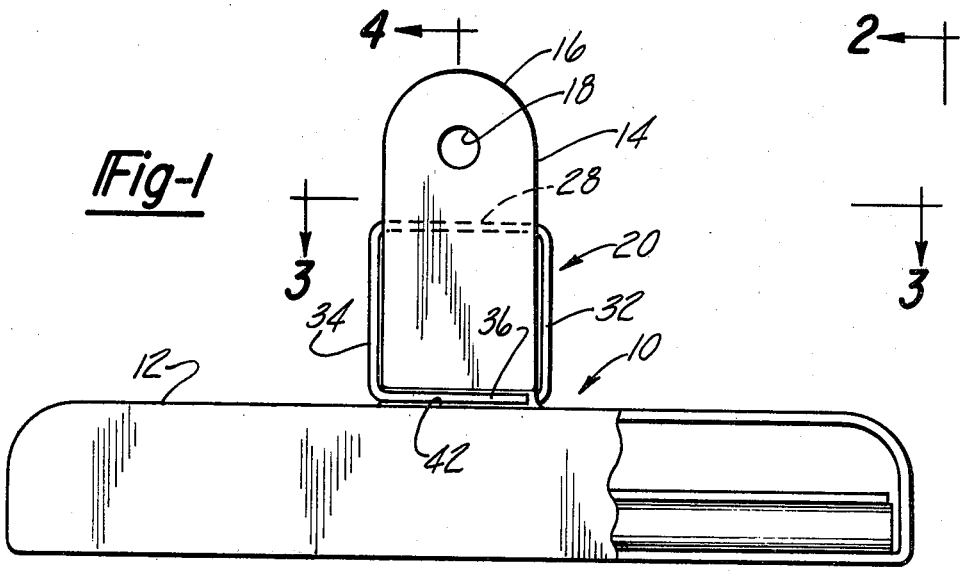
FIG. 1 is an elevation view of the food bag clamp of this invention.

Referring now to the drawings, there is shown an illustrative embodiment of the invention in a closure clamp for food bags and the like. In this embodiment, the clamp is useful for closing a food bag and also for hanging it from a suitable hook. Further, it is useful with various widths of food bags. It will be understood, as the description proceeds, that the invention is adapted for a variety of applications.

As shown in the drawings, the closure clamp comprises a pair of clamp members 10 and 10' and a torsion spring 20 which holds the members together and which closes the clamp. In the preferred embodiment, the clamp members 10 and 10' are identical to each other. Accordingly, clamp member 10 will be described in detail and the same description will be applicable to clamp member 10'; the same reference characters are used for corresponding parts of member 10' except that the prime symbol will be added thereto. Each clamp member 10 and 10' is preferably fabricated as a unitary body of plastic by injection molding. In the preferred embodiment, a styrene plastic is used but other materials would be satisfactory. Since the clamp members are of identical structure, both members may be made in the same mold.

The clamp member 10 comprises a jaw 12 which is of bar-like structure to provide a jaw which is wide relative to its depth. The clamp member 10 also includes a handle 14 which extends transversely of the jaw 12 and terminates in a free end 16. The handle 14 is also of bar-like structure and is long relative to its width. The handle 14 is provided with a hole 18 near its free end to permit hanging the clamp on a suitable hook.

Figure 2:
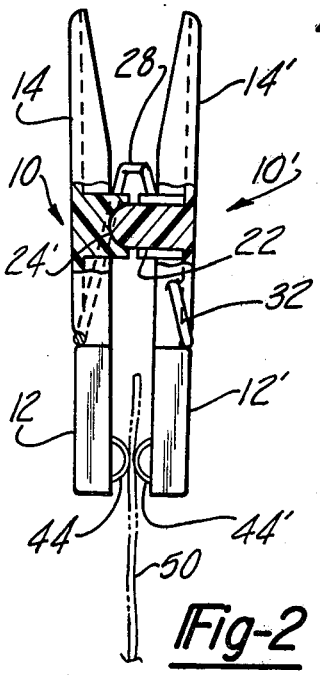
FIG. 2 is a view taken on lines 2—2 of FIG. 1.
Figure 3:
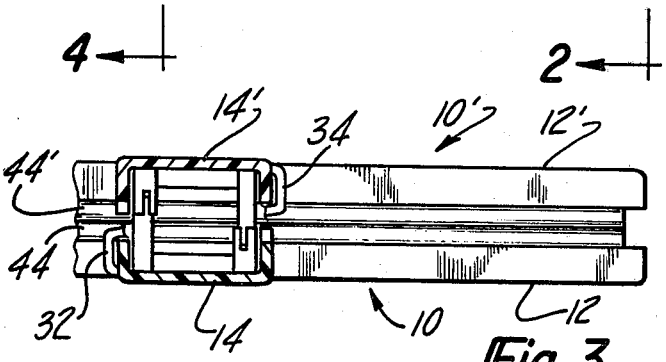
FIG. 3 is a view taken on lines 3—3 of FIG. 1.
Figure 4:
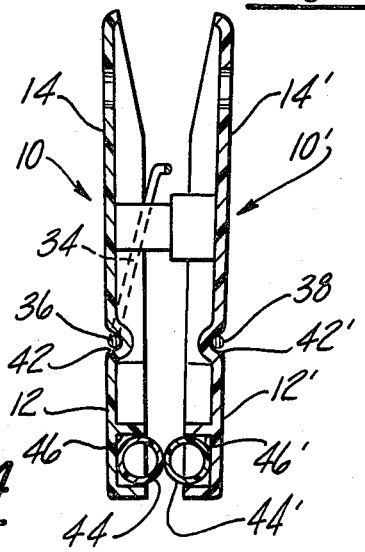
FIG. 4 is a view taken on lines 4—4 of FIG. 1.

A fulcrum means is provided on the handle 14 to provide for pivotal connection with the handle of the clamp member 10'. The fulcrum means comprises a post 22 extending transversely from the handle 10 and terminating in an arcuate surface at its free end. It also includes a socket 24 disposed in lateral alignment with the post 22. The socket 24 defines a recess having a bottom surface of arcuate configuration which corresponds to that of the surface of the free end of the post 22. Thus, the socket 24 is adapted to receive the free end of a post 22 in a pivotal engagement. As noted above, clamp member 10' is identical to clamp member 10. Accordingly, the clamp members may be juxtaposed as shown in FIGS. 2 and 4 with the post 22 of clamp 10 seated in the socket 24' of clamp 10' and with the post 22' of clamp 10' seated in the socket 24 of clamp member 10. With this arrangement, the fulcrum means of handles 14 and 14' are in pivotal engagement; they are retained together in this pivotal engagement by the torsion spring 20, in a manner which will be described presently.

The torsion spring 20 comprises a wire having an intermediate, straight torsion bar section 28 and a pair of side sections 32 and 34 which extend from opposite ends of the torsion bar section at right angles thereto. The side section 32 terminates in an end section 36 which extends generally parallel to the torsion bar section 28. Similarly, the side section 34 terminates in an end section 38 which extends generally parallel to the torsion bar section 28. The torsion bar section 28 is disposed between the fulcrum means and the free ends of the handles 14 and 14' and it extends transversely of the handles. The side section 32 of the spring extends along the side of the handle 14 and the end section 36 thereof is seated in a groove 42 in the outer surface of the handle 14. Similarly, the side section 34 of the spring extends along the side of the handle 14' and the end section 38 thereof is seated in a groove 42' in the handle 14'. When the spring 20 is in its free state, the torsion bar section 28 and the side sections 32 and 34 lie in substantially the same plane. When the clamp members 10 and 10' and the spring 20 are assembled, as shown in the drawings, the torsion bar section 28 is in torsional stress and the side sections 32 and 34 are in bending stress. Accordingly, the spring 20 not only holds the fulcrum means of the clamp members in engagement with each other but also exerts a torque about the pivot axis of the fulcrum means tending to close the jaws 12 and 12'.

The jaws 12 and 12' are provided with gripping members 44 and 44', respectively, which are adapted to engage opposite faces of a food bag disposed between the jaws. For this purpose, the jaw 12 defines a channel 46 which extends from one end of the jaw to the other. The gripping member 44 is a hollow tube of pliable material having a somewhat tacky surface. Preferably, the tube is polyethylene tubing of standard construction. The gripping member 44 is seated in the channel 46 and retained therein by a friction fit. A circumferential portion of the member extends outside the channel. The gripping member 44' is the same as member 44 and is seated in the channel 46' of jaw 12' in the same manner.

In use of the food bag clamp, the free ends of the handles 14 and 14' are squeezed together to open the jaws of the clamp. The food bag 50 which is to be closed by the clamp may be folded at its open end, if desired, but it is not necessary to do so. The open end of the food bag is inserted between the jaws of the clamp and the handles are released to allow the jaws to close. The force exerted by the spring 20 causes the gripping means 44 and 44' to engage the food bag on opposed surfaces thereof and to press the layers of the bag together. The force of the gripping members 44 and 44' tends to seal the bag and affords a sufficient gripping action that the bag may be hung by the handle of the clamp from a suitable hook.

Although the description of this invention has been given with reference to a particular embodiment, it is not to be construed in a limiting sense. Many variations and modifications will now occur to those skilled in the art. For a definition of the invention, reference is made to the appended claims.

What is claimed is:

1. A clamp for closing food bags and the like comprising, a pair of clamp members, each clamp member including a bar-like jaw which is wide relative to its depth and a bar-like handle which is long relative to its width, each of said jaws defining a channel extending the width thereof, a tube of pliable material coextensive with said channel and seated in said channel with a circumferential portion thereof extending outside the channel, each of said handles extending transversely from said jaw and terminating in a free end with a fulcrum means on the handle, said jaws being of equal length and said handles being of equal length, said clamp members being disposed with the fulcrum means of one clamp member in pivotal engagement with the fulcrum means of the other clamp member with said jaws, tubes and handles respectively opposite each other, said fulcrum means and said tubes holding the jaws and handles in spaced relation with clearance space between the jaws throughout the depth thereof to receive the end of a bag, and a torsion spring having a torsion rod disposed between said fulcrum means and the free ends of said handles with the free ends of the spring engaging the handles at the juncture thereof with the jaws and being adatped to hold said fulcrum means together and to urge said jaws closed, whereby said tubes are adapted to grippingly engage a bag along the full width of said jaws.

2. The invention as defined in claim 1 wherein said torsion spring comprises, a wire having an intermediate straight torsion bar section disposed between said handles and between the fulcrum means and the free ends of said handles, said wire having first and second straight side sections extending, respectively, along the first and second handles from opposite ends of said intermediate section toward said jaws, said wire terminating in first and second end sections extending, respectively, across said handles adjacent said jaws whereby said jaws are urged closed by said spring.

3. The invention as defined in claim 1 wherein, said fulcrum means on one of said handles comprises a post extending transversely thereof toward the other of said handles, and said fulcrum means on the other of said handles comprises a socket for receiving the end of said post in pivotal connection.

4. The invention as defined in claim 1 wherein, said fulcrum means on each of said handles comprises a post and a socket disposed in lateral alignment with each other, the post on one handle being received in pivotal engagement by the socket on the other handle.

5. The invention as defined in claim 4 wherein each clamp member is a unitary body of plastic, each clamp member being identical in construction to the other.

* * * * *